United States Patent [19]

Frye et al.

[11] Patent Number: 4,984,278

[45] Date of Patent: Jan. 8, 1991

[54] ADJUSTABLE MOUNT FOR A LOUDSPEAKER

[75] Inventors: Kent H. Frye, Buchanan; Wayne J. Kooy, Galien, both of Mich.; Paul F. Fidlin, South Bend, Ind.

[73] Assignee: Electro-Voice, Inc., Buchanan, Mich.

[21] Appl. No.: 224,116

[22] Filed: Jul. 25, 1988

[51] Int. Cl.[5] ..... H04R 1/02

[52] U.S. Cl. ..... 381/205; 248/278; 248/179; 381/87

[58] Field of Search ..... 248/179, 183, 278, 288.3, 248/288.5; 403/98, 84, 61; 381/87, 88, 89, 90, 188, 205

[56] References Cited

U.S. PATENT DOCUMENTS

| | | | |
|---|---|---|---|
| 2,594,242 | 4/1952 | Wilson | 248/278 |
| 2,922,609 | 1/1960 | Collier | 248/179 |
| 4,776,018 | 10/1958 | Cordier | 381/90 |

*Primary Examiner*—Forester W. Isen

*Attorney, Agent, or Firm*—Burmeister, York, Palmatier & Zummer

[57] ABSTRACT

An adjustable mount for a loudspeaker having a plate adapted for mounting on a surface or the open side of a junction box. The plate has an indented part-spherical surface which accommodates a ring with an outer part-spherical surface. The ring has an aperture extending therethrough and an elongated slot, and a first hollow tube is rotatably disposed in the aperture and a second hollow tube is translatably disposed in the slot. One of the tubes extends through an opening in the recess of the plate and the other tube is mounted on the loudspeaker with the conductor for energizing the loudspeaker extending through the first and second tubes. A web extends radially inward of the ring and has bifurcations at the end thereof disposed on opposite sides of the portion of the conductor between the first and second tubes. The first and second tubes have external threads which are engaged by locknuts for securing the ring on the plate and on the loudspeaker.

17 Claims, 3 Drawing Sheets

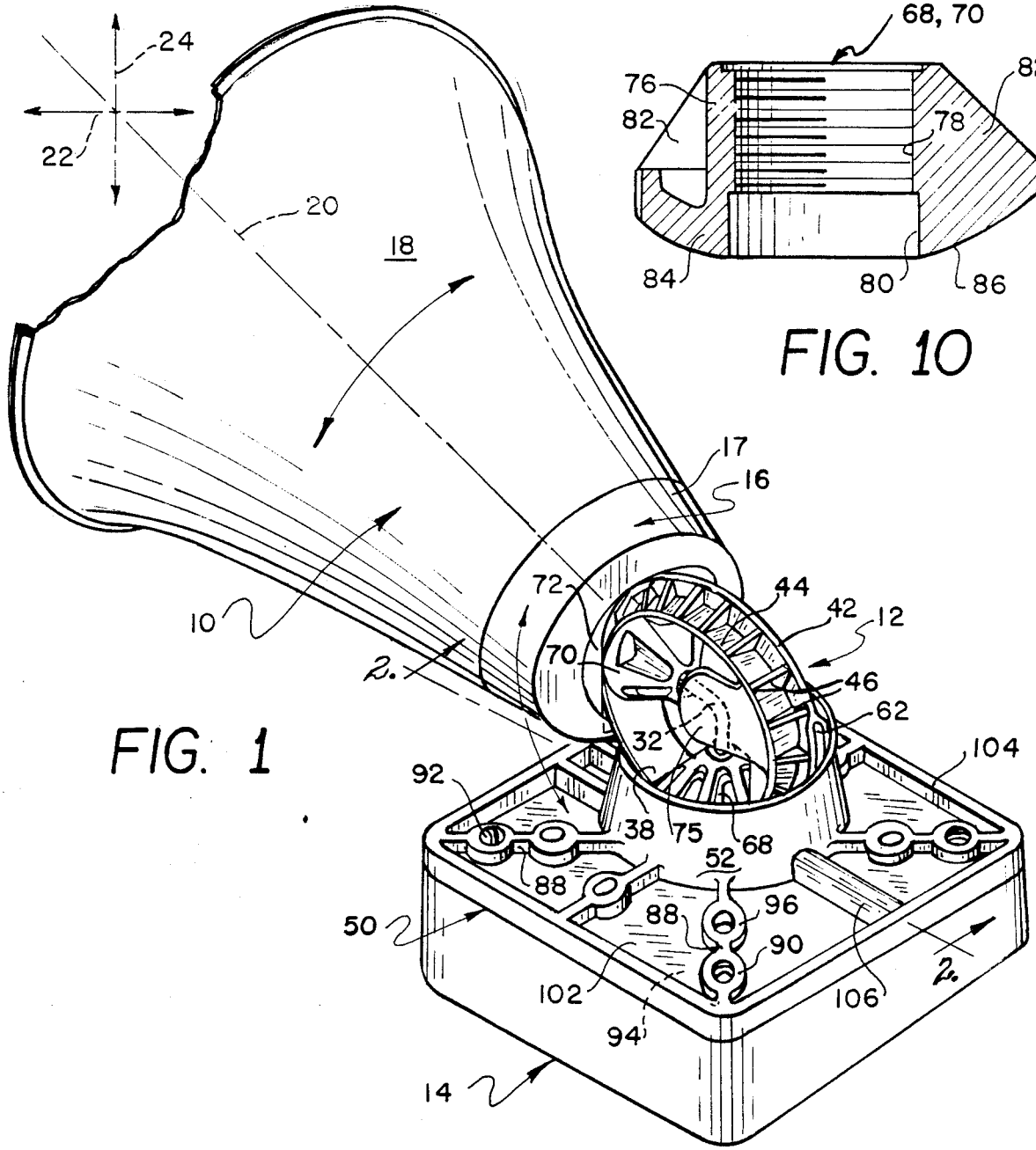
FIG. 1
FIG. 10
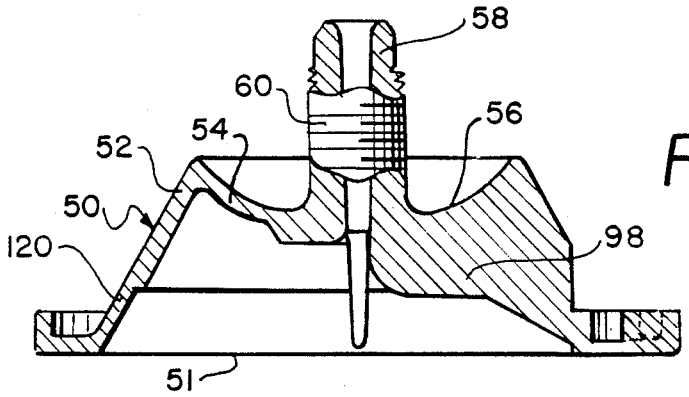
FIG. 6

ADJUSTABLE MOUNT FOR A LOUDSPEAKER

The present invention relates to adjustable mounting structures, and particularly to such mounting structures for use with projecting horn loudspeakers.

BACKGROUND OF THE INVENTION

Public address systems require loudspeakers which direct sound toward a particular location, and loudspeakers used for such services are generally directional loudspeakers designed for conveying intelligence. Horn projectors have proven to be particularly suitable for such service, and may be used in buildings or outside of buildings, either permanently installed or as portable units. In all applications, the loudspeaker must be directed toward a particular location, and adjustable mounts are generally provided to facilitate this adjustment.

Further, some loudspeakers, particularly certain horn loudspeakers, project sound with a greater angle of dispersion in one plane than in the plane normal thereto, the planes being referred to as the major and minor axes of propagation of the speaker. It is necessary to align the axes of such speakers with the major and minor axes of the area to be serviced.

One type of adjustable mount which is in commercial use has a mounting plate with an outwardly extending circular flange which is removably attached by a bolt and wing-nut to a circular flange extending outwardly from a horn loudspeaker. The horn loudspeaker may be rotated on the bolt to the desired angle and thereafter locked in place by tightening the wing-nut. In some cases, the mounting plate is mounted on a base for rotation about an axis normal to the bolt to provide additional adjustability.

U.S. Pat. No. 2,922,609 of W. D. Collier dated Jan. 26, 1960, entitled ADJUSTABLE MOUNT discloses another mounting structure in which a based supports a threaded pin and a circular disc is rotatably journaled on the pin. The disc has a recess in the form of part-cylindrical slot, and a cradle with a mating part-cylindrical surface is slidably disposed within the recess. The cradle has an elongated slot which accommodates the pin and permits the cradle to translate in the recess of the plate. The item to be positioned is mounted on the cradle, and by translating the cradle and rotating the disc, the item may be directed as desired. A nut engages the threaded pin, and tightening the nut locks the structure.

In another mounting structure, a load carrying element in the form of a part-cylindrical ball is mounted on a retaining yoke, as disclosed in U.S. Pat. No. 4,515,336 of William H. Fischer dated May 7, 1985, and entitled BALL AND SOCKET MOUNT FOR OPTICAL SENSING SOURCE AND/OR DETECTOR DEVICES. Devices of this type provide limited adjustability due to interference of the yoke.

U.S. Pat. No. 4,415,136 of Paul R. Knoll dated Nov. 15, 1983, and entitled PEDESTAL FOR CONSOLES describes still another mounting structure capable of movement against constant frictional restraint in which a part spherical member is journaled against a seat carried by a base.

For purposes of adjusting the direction of sound radiation of a loudspeaker that has a wider sound dispersion in one plane than in the plane normal thereto, it is generally desirable to adjust the general direction of propagation of sound first and thereafter align the sound pattern to the area being serviced. Accordingly, it is an object of the invention to provide a mounting structure with independent adjustment means operable to adjust the direction of propagation and the alignment of the pattern of the sound propagation with the area to be serviced, and to provide means for separately and independently locking each adjustment means against movement.

In practice, loudspeaker mounting structures of the type described above have proven to have disadvantages. The mounting structure is independent of the connecting cable to the loudspeaker. Further, the cable generally extends from a portion of the loudspeaker housing remote from the adjustable mounting means, and the cable is exposed and subject to wear and abuse.

It is an object of the invention to provide a mounting structure particularly designed for use with directional loudspeakers, such as horn projectors. In particular, it is an object of the invention to provide such a structure with a base designed to facilitate mounting on walls or other structures.

It is also an object of the invention to provide a mounting structure which has means for guiding and protecting the connecting cable for the loudspeaker. Further, it is an object of the invention to provide a mounting structure for a loudspeaker which may be directly mounted on a junction box and the cable of the loudspeaker connected within the junction box to wires for energizing the loudspeaker.

SUMMARY OF THE INVENTION

In accordance with the present invention, a loudspeaker of the type having a principal axis of sound propagation is provided with a tube extending outwardly therefrom. The tube is a part of an adjustable mount for the loudspeaker, and the adjustable mount has a plate adapted to be mounted on a desired structure. One side of the plate is intended to be mounted on the structure, and the plate has a second tube extending outwardly from the other side thereof and a surface of revolution surrounding the second tube. A member, preferably in the form of a ring with an aperture extending therethrough and a slot spaced from the aperture and disposed in a plane aligned with the aperture, is mounted on the second tube, the ring conforming to the surface of revolution of the plate and being in abutment therewith. The adjustable mount has adjustable means for locking the loudspeaker on the member, preferably in the form of a first nut threaded on the first tube, and also means for locking the member on the plate preferably in the form of a second nut threaded on the second tube.

In a preferred construction, the first and second tubes of the support structure are hollow, and a cable from the loudspeaker extends through the tubes for connection to a sources of audio signals for energizing the loudspeaker. Preferably, the ring is provided with a bifurcated web extending from the ring toward the center thereof, thereby positioning bifurcations of the web on opposite sides of the cable to protect the cable.

In a preferred construction, the plate is also provided with the size, shape and design of a junction box cover, so the plate may be directly mounted on an open junction box and function as the cover thereof. When so mounted, the cable extends through the first and second hollow tubes into the junction box for connection to mating cables within the junction box. The plate is also designed for mounting directly on a wall or other structure, including a surface of a motor vehicle.

DESCRIPTION OF THE DRAWINGS

The objects and advantages of the present invention will be more fully understood with reference to the accompanying drawings, in which:

FIG. 1 is an isometric view of a loudspeaker, adjustable mounting means, and junction box constructed in accordance with the teachings of the present invention;

FIG. 6 is a sectional view of the mounting plate taken along the line 6—6 of FIG. 4;

FIG. 10 is an enlarged sectional view of one of the locking devices illustrated in FIGS. 1 and 2, the planes of the left half and right half of the view being different to illustrate the recesses and ribs thereof.

BRIEF DESCRIPTION OF THE INVENTION

Figure 2:
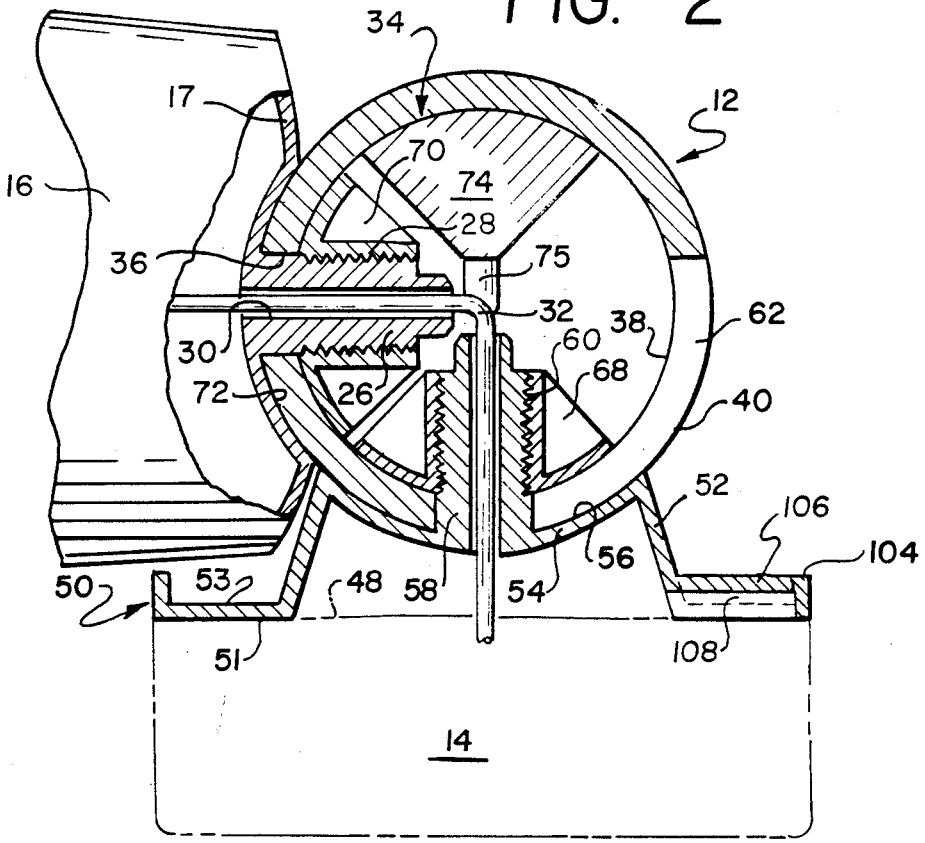
FIG. 2 is a sectional view of the structure of FIG. 1 taken along the line 2—2 thereof.
Figure 3:
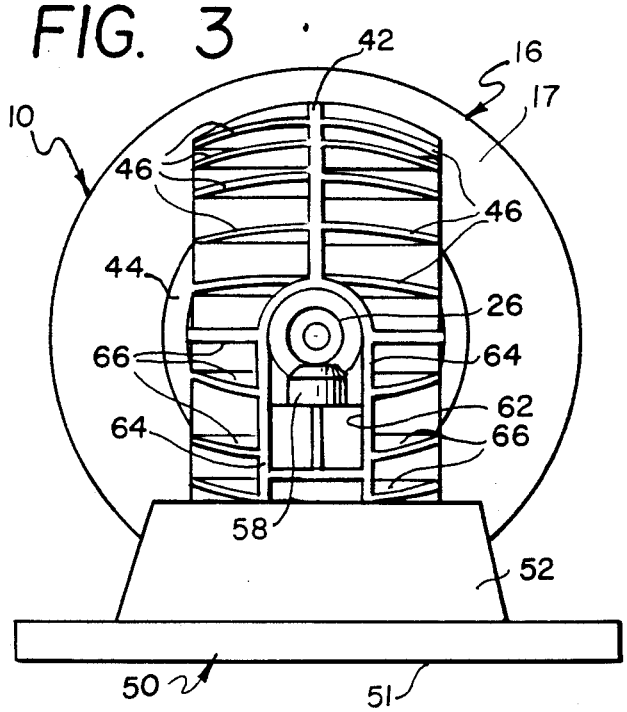
FIG. 3 is a rear elevational view of the loudspeaker and adjustable mounting means of FIGS. 1 and 2.
Figure 7:
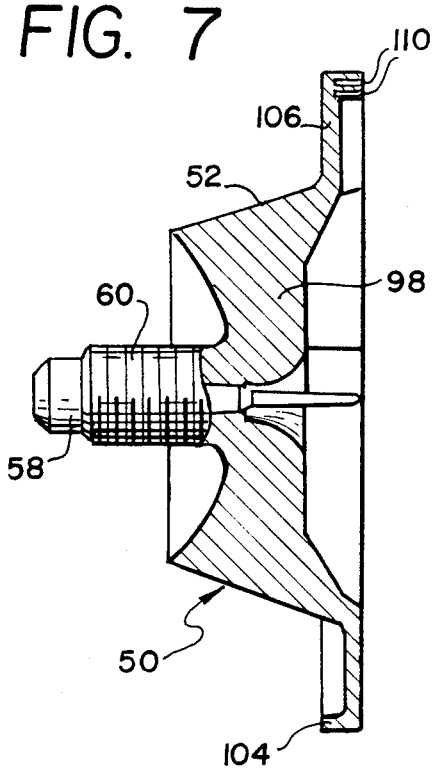
FIG. 7 is a sectional view of the mounting plate taken along the line 7—7 of FIG. 4.

As illustrated in FIG. 1, a loudspeaker 10 is mounted on an adjustable mounting 12, which is, in turn, mounted on a junction box 14. The loudspeaker 10 has a driver 16 which has a casing 17 is mounted on the adjustable mounting 12, and an outwardly flaring horn 18 which extends from the driver 16. The horn 18 provides a central axis of sound propagation 20, and the sound disperses outwardly from the axis 20. Further, the sound may disperse uniformly from the axis 20 and have a circular sound pattern, or the pattern may have a wider angle in one direction, as indicated by the horizontal line 22, than in the other direction, as indicated by the vertical line 24. The sound pattern of the loudspeaker 10 is controlled by the horn 18, and in the illustrative embodiment of FIG. 1, the pattern is as indicated by the lines 22 and 24 to form an elliptical sound pattern.

The adjustable mounting 12 has a first tube 26 mounted at one end on the casing 17 of the driver, and the tube 26 is coaxial with the axis 20 of sound propagation and extends outwardly from the side of the driver 16. The first tube 26 is provided with threads 28 on its outer surface and has an axial channel 30 which extends therethrough and opens into the casing 17 of the driver 16. A conductor 32 for carrying electrical signals to energize the driver 16 extends from the driver outwardly through the channel 30.

The adjustable mounting 12 has a ring 34 with an aperture 36 extending therethrough, and the first tube 26 is rotatably disposed within the aperture 36 of the ring. The ring 34 has a cylindrical inner surface 38, and a part-spherical outer surface 40 formed by a rib 42 which extends outwardly from a cylindrical outer surface 44 and a plurality of spaced cross ridges 46 which extend from the cylindrical surface 44 to the rib 42.

The junction box 14 has an open side 48 to access conductors in the junction box, and a plate 50 is mounted on the junction box 14 with one side 51 thereof confronting the interior of the junction box 14. A collar 52 extends outwardly centrally of the other side of the plate 50 in the form of a truncated cone, and the end of the collar opposite the plate 50 terminates in a indented wall 54 with an outer surface 56 in the form of a spherical segment. A second hollow tube 58 extends outwardly from the center of the wall 54, and the tube 58 is provided with threads 60 on its outer surface.

The ring 34 is provided with a slot 62 which extends along the central plane of the ring and interrupts the rib 42. The slot 62 has a width slightly greater than the diameter of the second tube 58, and the ring 34 is positioned in abutment with the surface 56, the second tube 58 being slidably disposed within the slot 62. Secondary ribs 64 are disposed on opposite edges of the slot 62 and are jointed with the rib 42 to form a continuous rib structure about the perimeter of the ring 34. A second group of cross ridges extend from the secondary ribs 64 to the cylindrical outer surface 44. The secondary ribs 64 and second group of cross ridges 66 continue the part-spherical outer surface 40 of the ring 34 in the region of the slot 62.

The ring 34 is locked into position on the plate 50 by means of a nut 68 which engages in the threads 60 of the second tube 58, the nut 68 wedging the ring 34 against the surface 56 by applying force on the cylindrical inner surface 38 of the ring. In like manner, a second nut 70 engages the threads 28 of the first tube 26 to lock the ring 34 on the loudspeaker 10. The driver 16 of the loudspeaker has an indented surface 72 which surrounds the first tube 26 and is a spherical segment to provide a mating surface for engaging the ring 34. The conductor 32 which extends through the hollow first tube 26 continues through the hollow second tube 58 and into the junction box 14. To protect the region of the conductor between the first hollow tube 26 and the second hollow tube 58, the ring is provided with a flat web 74 which extends radially inwardly from the cylindrical inner surface 38 of the ring 34, and the web 74 has a bifurcated U-shaped end opposite the ring 34, the bifurcations 75 being disposed on opposite sides of the conductor 32 to protect the portion of the conductor extending between the first tube 26 and the second tube 58.

The nuts 68 and 70 are designed to facilitate adjustment by the installer and to provide solid frictional contact with the ring 34. As illustrated in FIG. 10, the nuts 68 and 70 have a cylindrical hollow sleeve 76 provided with threads 78 on the inner surface thereof, and a cylindrical portion 80 of larger diameter 80 adjacent to one end of the inner surface of the sleeve to form a relief for the nuts. Wings 82 extend outwardly from the sleeve 76 and a circular shell 84 and extends outwardly from the relief portion 80 and is integral with the wings. The shell 84 has an outer surface 86 which is a spherical segment and abuts the inner surface 38 of the ring 34.

When the first nut 68 on the second tube 58 is loosened, the loudspeaker 10 may be directed in any direction desired throughout a range of 180°. The slot 62 permits rotation of the ring 34 throughout angle of 90°, and since the ring 34 may be rotated on the surface 56 about the second tube 58, the loudspeaker may be adjusted throughout the full 180° range. After the loudspeaker has been directed toward the service area, the nut 68 is tightened thereby locking the ring 34 on the plate 50 and locking the direction of the axis 20 of the horn 18. The second nut 70 may be loosened, the horn 18 rotated on the axis of the first tube 26 to orient the major axis and minor axis of sound propagation with the major and minor axes of the service area. The nut 70 is then tightened against the ring 34 to secure the loudspeaker 10 on the ring, thereby locking the entire adjustable mount 12 against further adjustment.

Figure 8:
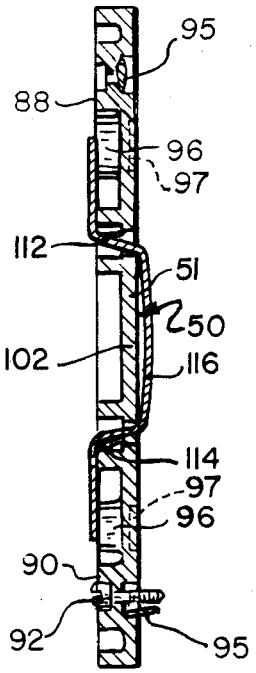
FIG. 8 is a sectional view of the mounting plate taken along the line 8—8 of FIG. 4.

The plate 50 is designed to be mounted in a plurality of different ways. As illustrated in FIGS. 1 and 2, the plate 50 is mounted on the open side 48 of the junction box 14. FIG. 1 illustrates a plurality of radial ribs 88 which extend outwardly from the collar 52 and are provided with rings 90 which are adapted to receive bolts 92 which engage inwardly extending tabs 94 of the junction box 14 to secure the plate 50 on the junction box 14. The plate 50 is provided with four such rings 90 located at the four corners of the rectangular plate 50 to engage the tabs of a conventional rectangular junction box of that particular size, and the plate has knock-outs 95 to receive the bolts 92, as illustrated in FIG. 8. The plate 50 is also provided with a second set of four rings 96 disposed at the corners of a smaller rectangle which are provided with knock-outs 97 adapted to receive bolts to engage the tabs of a smaller rectangular junction box, not shown. In order to increase the strength and rigidity of the plate 50, radial webs 98 extend outwardly from the second tube 58 across the region of the collar 52, but the webs 98 do not interfere with the one side 51 of the plate 50 which is flat. Since the side 51 is flat, the plate 50 may be mounted flush on any flat surface, and the rings 90 and 96 may be utilized for screws or bolts for that purpose.

The plate 50 has a flat skirt 102 which extends inwardly from a rectangular frame 104 to the collar 52, the frame 104, rings 90 and 96 rising from the surface or side 51 of the plate. When the plate 50 is mounted on a flat surface, the surface 51 abutting the flat surface, the conductor 32 can be accessed on the mounting surface. A part tubular protrusion 106 rises from the skirt 102 and extends between the collar 52 and the frame 104. The protrusion 106 forms a channel 108 between the interior of the collar 52 and the frame 104, and the frame 104 is provided with a knock-out 110 to permit the channel 108 to be opened for the conductor.

Figure 4:
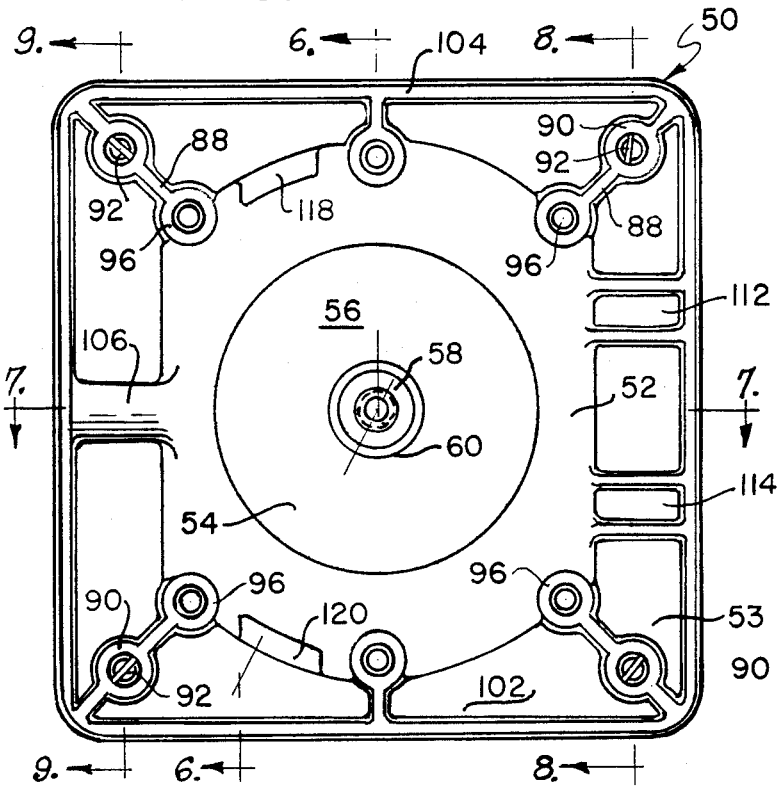
FIG. 4 is a top plan view of the mounting plate of the adjustable mounting illustrated in FIGS. 1 through 3.

FIGS. 4 and 8 illustrate knock-outs 112 and 114 for use in mounting the plate on a surface by means of a strap, the strap being fragmentarily illustrated at 116 in FIG. 8. The surface 51 may be placed against a surface upon which it is to be mounted, and the knock-outs 112 and 114 removed by means of a screwdriver or the like, and the strap 116 threaded through the knock-outs, as illustrated in FIG. 8. The strap may be secured on the mounting object to cause the plate to remain in a fixed position on that surface.

Figure 5:
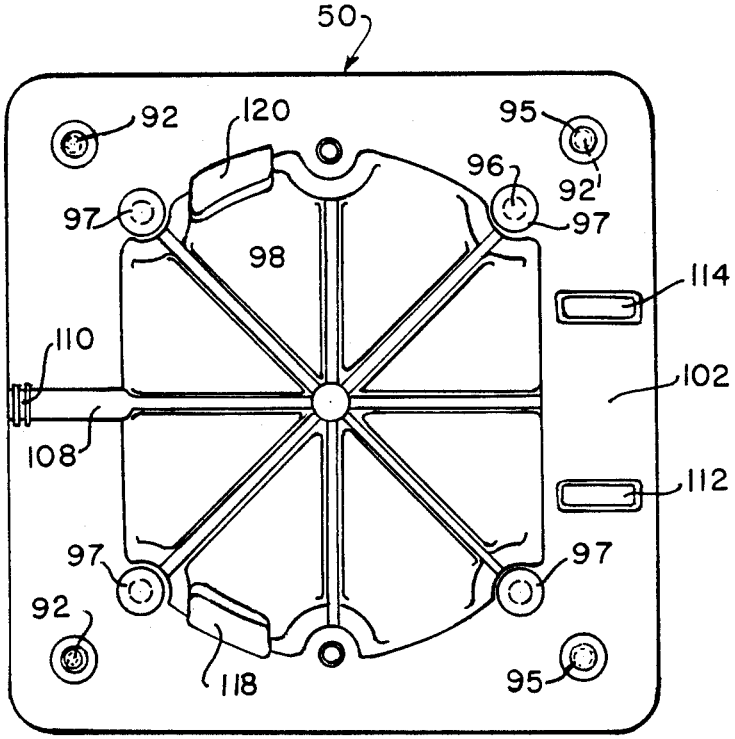
FIG. 5 is a bottom elevational view of the mounting plate of FIG. 4.
Figure 9:
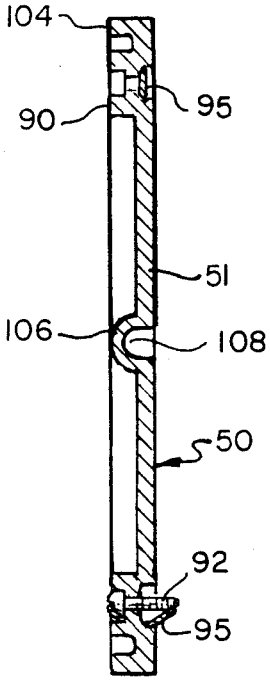
FIG. 9 is a sectional view of the mounting plate taken along the line 9—9 of FIG. 4.

As illustrated in FIGS. 4, 5 and 6 knock-outs 118 and 120 are also provided in the collar 52 to receive a strap for the same purpose. In both cases, the strap passes over a portion of the skirt 102 before entering the knock-out and passing on the opposite side of the skirt.

From the foregoing disclosure, those skilled in the art will devise many uses and modifications of the present invention. It is, therefore, intended that the scope of the present invention be not limited by the foregoing specification, but rather only by the appended claims.

The invention claimed is:

1. A combination loudspeaker and adjustable mounting comprising, in combination: a loudspeaker having a principal axis of sound propagation; and an adjustable mount engaging the loudspeaker comprising a plate adapted to be mounted on a structure or the open side of a terminal box, the plate having one side adapted to confront the structure or terminal box and another side adapted to face outwardly from the structure, said plate having a concave part spherical first surface on the other side thereof, a first tube mounted on the plate and protruding from the first surface, a second tube mounted on the loudspeaker, a member having an aperture extending therethrough and a portion extending from the aperture with a part spherical second surface conforming to the first surface of the plate, the second surface of the member slidably engaging the first surface of the plate, said portion being provided with a slot extending through the second surface and disposed in a plane extending through the aperture, one of the tubes being disposed in the aperture of the member and the other of the tubes being slidably disposed in the slot of the member, a first means for locking the one tube on the member, and an adjustable second means for locking the other tube on the member.

2. A combination loudspeaker and adjustable mounting comprising the combination of claim 1 wherein the loudspeaker is provided with a part spherical concave second surface disposed about the second tube, and the member is a circular ring.

3. A combination loudspeaker and adjustable mounting comprising the combination of claim 2 wherein the ring has first and second outwardly extending ribs disposed along the edges of the slot and a third rib extending between the ends of the slot in the plane of the slot.

4. A combination loudspeaker and adjustable mounting comprising the combination of claim 2 wherein the ring has a plurality of spaced ridges disposed on axes normal to the plane of the slot extending outwardly therefrom, said ridges having outer ends forming the second surface.

5. A combination loudspeaker and adjustable mounting comprising the combination of claim 1 wherein the second tube is provided with threads on the outer surface thereof, and the means for locking the second tube on the member comprises a locknut threadedly engaging the threads on the second tube.

6. A combination loudspeaker and adjustable mounting comprising the combination of claim 1 wherein the first tube and the second tube are hollow and the end of the first tube confronts the end of the second tube, the loudspeaker having an electrical conductor extending therefrom, and the conductor of the loudspeaker extending through the first and second tubes.

7. A combination loudspeaker and adjustable mounting comprising the combination of claim 6 wherein the member is provided with walls extending radially inward from the part spherical second surface, said walls being disposed on opposite sides of the first and second tubes and the portion of the conductor extending between the first and second tubes.

8. A combination loudspeaker and adjustable mounting comprising the combination of claim 7 wherein the member comprises a hollow ring, the radially inwardly extending walls of the ring comprise a flat web extending from the ring in the plane of the slot and having a bifurcated U-shaped end opposite the ring.

9. A combination loudspeaker and electrical terminal box mounting comprising the combination of claim 1 wherein the first tube is integral with the plate.

10. A combination loudspeaker and adjustable mounting comprising the combination of claim 1 wherein the plate adapted to be mounted on the structure or the open side of the terminal box has a plurality of spaced openings adapted to confront and align with channels extending into the structure or terminal box, said openings being adapted to receive fastening members to be anchored in channels located in the structure or terminal box.

11. A combination loudspeaker and adjustable mounting comprising the combination of claim 1 wherein the one side of the plate is provided with an indentation forming a third concave surface disposed about the first tube having the same radius of curvature as the first surface.

12. A combination loudspeaker and electrical terminal box mounting comprising the combination of claim 11 wherein the one side of the plate is provided with an inwardly extending groove from the indentation to the perimeter of the plate, the groove being adapted to accommodate an electrical conductor within the indentation.

13. A combination loudspeaker and electrical terminal box mounting comprising the combination of claim 11 wherein the plate is provided with a depending collar from the perimeter of the first surface, said collar forming the perimeter of the third surface and a flat skirt extending outwardly from the collar.

14. A combination loudspeaker and electrical terminal box mounting comprising the combination of claim 13 wherein the plate is provided with a plurality of webs depending outwardly from the third surface and extending from the collar to the skirt.

15. A combination loudspeaker and electrical terminal box mounting comprising the combination of claim 13 wherein the collar is provided with a pair of elongated narrow orifices adjacent to the other surface of the plate, the orifices being disposed on an axis displaced from the first tube and adapted to receive and engage a flat strap for mounting the loudspeaker and adjustable mounting on a structure.

16. A combination loudspeaker and electrical terminal box mounting comprising the combination of claim 15 wherein the plate is provided with a pair of elongated cut-outs adjacent to the perimeter thereof, the cut-outs being spaced from each other by a distance less than the distance between the orifices and being adapted to receive a strap for mounting on a relatively smaller structural element.

17. A combination loudspeaker and adjustable mounting comprising, in combination: a loudspeaker having a principal axis of sound propagation; and an adjustable mount engaging the loudspeaker and adapted to be mounted on a structure or a terminal box open on one side, said adjustable mount comprising a plate adapted to be mounted on a structure or the open side of the terminal box having a plurality of spaced openings adapted to confront and align with channels extending into the structure or terminal box, said openings being adapted to receive fastening members to be anchored in the channels of the structure or terminal box, said plate having one side confronting the structure or terminal box and another side facing outwardly from the structure or terminal box, said plate having a hollow first tube integral therewith extending outwardly from the other side thereof provided with threads on the outer surface thereof, said plate having a first concave surface of revolution surrounding the hollow first tube, the one side of the plate being provided with an indentation forming a second convex surface having the same radius of curvature as the first surface, the one side of the plate being provided with an inwardly extending groove from the indentation to the perimeter of the plate, the groove being adapted to accommodate an electrical conductor for connection within the indentation with a conductor of the speaker, the plate being provided with a depending collar from the perimeter of the first surface, said collar forming the perimeter of the second surface, the plate being provided with a plurality of radially oriented webs depending outwardly from the second surface and from the collar to the skirt, the collar being provided with a pair of elongated narrow orifices adjacent to the other surface of the plate, the orifices being disposed on an axis displaced from the first tube and adapted to receive and engage a flat strap for mounting the loudspeaker and mount on a structure, the plate being provided with a pair of elongated cut-outs adjacent to the perimeter thereof, the cut-outs being spaced from each other by a distance less than the distance between the orifices and being adapted to receive a strap for mounting on a relatively smaller structural element, said loudspeaker having a support means provided with a concave part spherical third surface and a hollow second tube extending outwardly therefrom, the second tube being provided with threads on the outer surface thereof, said loudspeaker having an electrical conductor extending from the second tube and through the first tube for connection with a source of audio electrical signals; a ring having an aperture extending therethrough and a portion spaced from the aperture provided with a slot disposed in a plane extending through the aperture, one of the tubes being rotatably disposed in the aperture of the ring and the other of the tubes being slidably disposed in the slot, the ring having an outer surface slidably abutting and conforming to the first concave surface of the plate and the concave third surface of the loudspeaker, one of the tubes being rotatably disposed within the aperture of the ring and the other of the tubes being translatably disposed within the slot of the ring, the ring having a flat web extending from the ring in the plane of the slot and having a bifurcated U-shaped end opposite the ring disposed on opposite sides of the first and second tubes and the portion of the conductor extending between the first and second tubes, the ring having first and second outwardly extending ribs along the edges of the slot and a third rib extending in the plane of the slot between the ends of the slot, the ring having a plurality of spaced cross ridges disposed on axes normal to the plane of the slot extending outwardly therefrom, a first locknut threadedly engaging the threads on one of the tubes, and a second locknut threadedly engaging the threads on the other of said tubes.

* * * * *